United States Patent [19]

Eishima et al.

[11] 4,205,206

[45] May 27, 1980

[54] CARBON GRANULE MICROPHONE WITH MOLDED RESIN-CONDUCTIVE CARBON ELECTRODE

[75] Inventors: Tetsusuke Eishima; Takehiro Ikariyama, both of Tokyo; Raizo Jinnouchi, Machida; Kunioki Oyagi, Tokyo; Takashi Soda, Inagi, all of Japan

[73] Assignees: Iwatsu Electric Co. Ltd.; Nippon Telegraph and Telephone Public Corp., both of Tokyo, Japan

[21] Appl. No.: 886,156

[22] Filed: Mar. 13, 1978

Related U.S. Application Data

[63] Continuation of Ser. No. 736,408, Oct. 28, 1976, abandoned.

[30] Foreign Application Priority Data

Oct. 31, 1975 [JP] Japan ..... 50-130324
Dec. 15, 1975 [JP] Japan ..... 50-148455

[51] Int. Cl.[2] ..... H04R 21/02
[52] U.S. Cl. ..... 179/124
[58] Field of Search ..... 179/124, 140, 190

[56] References Cited

U.S. PATENT DOCUMENTS

| | | | |
|---|---|---|---|
| 308,956 | 12/1884 | Eckert | 179/124 |
| 549,803 | 11/1895 | Lucas | 179/190 |
| 587,654 | 8/1897 | Enholm | 179/190 |
| 1,535,276 | 4/1925 | Whitaker | 179/124 |
| 1,689,844 | 10/1928 | Slepian | 179/190 |

FOREIGN PATENT DOCUMENTS

| | | | |
|---|---|---|---|
| 301656 | 12/1928 | United Kingdom | 179/124 |
| 526212 | 9/1940 | United Kingdom | 179/124 |
| 594116 | 11/1947 | United Kingdom | 179/124 |

*Primary Examiner*—George G. Stellar
*Attorney, Agent, or Firm*—Paul & Paul

[57] ABSTRACT

Disclosed is an electrode for a carbon transmitter which comprises a body of an electrically conductive material, such as metal or a conductive resin, with at least a part of the surface of the body comprising electrically conductive carbon. Such an electrode may be prepared by applying a carbon coating onto the metallic substrate or by molding a molding resin material having particulate conductive carbon dispersed therein. The electrode has stable electrical properties comparable to those of the known gold-plated electrode.

8 Claims, 5 Drawing Figures

CARBON GRANULE MICROPHONE WITH MOLDED RESIN-CONDUCTIVE CARBON ELECTRODE

This is a continuation of application Ser. No. 736,408, filed Oct. 28, 1976, now abandoned.

The present invention relates to an electrode for a carbon transmitter of a telephone, which electrode has stable mechanical and electrical properties and can be manufactured at low costs.

In a carbon transmitter, the vibration of a diaphragm caused by a voice is transmitted to a movable electrode attached to the diaphragm to cause migration in carbon granules packed between this movable electrode and a fixed electrode. As a result the resistance between both the electrodes is caused to change and this change in the resistance leads to a change in the voltage. Accordingly, the movable and fixed electrodes of the carbon transmitter should have mechanical properties sufficient to resist vibrations and shocks while the transmitter is being used. Further, these electrodes are required to have a good conductivity, and the contact resistance between the electrodes and the carbon granules must be low and stable with the lapse of time. In carbon transmitters, since the carbon granules fall in contact with the electrodes and separate therefrom while an electric current is being supplied, arcs are generated and there is brought about such a condition that the surfaces of the electrodes are readily oxidized. If the electrode surfaces are oxidized for any reason, the contact resistance between the electrodes and the carbon granules increases, which results in changes in the dynamic resistance, sensitivity and noise of the transmitter.

Electrodes of a type wherein copper is used as the substrate, so as to enhance the conductivity of the electrodes, and wherein the surface of the copper substrate is plated with gold to render the surface stable against oxidation, are at present widely used as movable and fixed electrodes of carbon transmitters. While electrodes of this type and carbon transmitters equipped with such electrodes have stable electrical and mechanical properties, they are expensive since gold is used. It may be considered to replace gold plating with plating of other metals. However, if a noble metal is used for plating, the electrodes become as expensive as the gold-plated electrodes, and if a metal other than a noble metal is used, sufficient stability can not be obtained and the properties of the resulting electrodes change with time to an unacceptable extent.

Electrodes formed by machining graphite have been proposed in the art. However, such graphite electrodes are likely to break down due to shocks received from the telephone being dropped or the like because of their inferior mechanical strength. Further, while it is desired to form a smooth spherical face on that part of the surface which is to fall in contact with carbon granules, it is very difficult to provide graphite electrodes with such a smooth spherical face by a machining operation.

It is, therefore, a primary object of the present invention to provide an electrode for use in a carbon transmitter which has mechanical and electrical properties comparable to those of the conventional gold-plated electrode and which can be manufactured at low costs with ease.

This object can be attained, in accordance with the present invention, by an electrode for a carbon transmitter which comprises a body of an electrically conductive material selected from the group consisting of cured thermosetting resins having particulate conductive carbon dispersed therein and normally stable metals, at least a part of the surface of said body comprising electrically conductive carbon.

The invention will now be described with reference to the accompanying drawings, in which.

Figure 1:
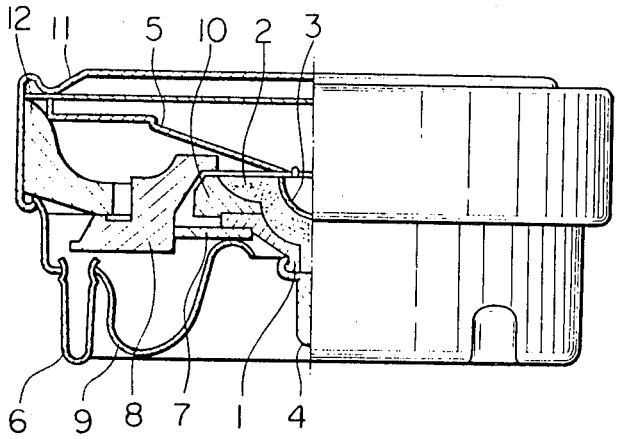
FIG. 1 is a partially cut-out side view illustrating a typical carbon transmitter.

In the carbon transmitter illustrated in FIG. 1, there are operably mounted a fixed electrode 1, a pack of carbon granules 2, a movable electrode 3, a terminal 4 for the fixed electrode, a diaphragm 5, a terminal 6, an insulating plate 7, an inner frame 8, a cover 9, a carbon chamber insulator 10, a protecting plate 11 and an outer frame 12. According to the invention, one or both of the fixed electrode 1 and the movable electrode 3 should have the above-defined structure.

In accordance with one aspect of the invention, there is provided an electrode for a carbon transmitter which comprises a substrate of electrically conductive normally stable metal and a superstrate of electrically conductive carbon covering at least a part of the surface of said substrate.

Such an electrode may be prepared by shaping a normally stable metal, preferably copper, into an article of desired shape and size, for example into a form of the fixed electrode 1 or movable electrode 3 shown in FIG. 1, and then forming a superstrate of electrically conductive carbon on the surface of the metallic article so shaped. The formation of the carbon superstrate may be carried out by any suitable technique, for example, by the application of an electrically conductive paint containing at least 30% by weight of particulate conductive carbon based on the weight of the solid in the paint, or by carbon deposition, or by vacuum evaporation or spattering of carbon.

The carbon deposition is a known technique in which a vapor of an organic compound capable of being thermally decomposed to a carbonaceous substance is passed over the substrate heated at a high temperature in an inert gas atmosphere to thereby deposit carbon on the substrate. For example, a carbon film can be conveniently formed on the substrate by heating the substrate at a temperature of about 800° to 1000° C. in a nitrogen atmosphere and passing a vapor of a hydrocarbon of a high carbon content, such as benzene, over the so heated substrate.

Vacuum evaporation and spattering of carbon may be accomplished according to techniques respectively known as vacuum evaporation and spattering of metals. More specifically, in the case of vacuum evaporation, a high electrical current is supplied to a carbon electrode in a vacuum chamber of the order of $10^{-4}$ to $10^{-6}$ mmHg, whereby heat is formed and carbon vapor is emitted from the electrode. In the vacuum chamber a substrate to be coated with carbon is placed on the path of the emitted carbon vapor. The carbon vapor linearly advances, impinges on the substrate and is deposited on the surface of the substrate. In the case of spattering, a voltage of several hundred volts, with a current of several to about one hundred mA, is applied between a carbon cathode and a coacting anode in a vacuum tank maintained at a pressure of about $10^{-3}$ to $10^{-2}$ mmHg and a temperature of about 150° to 350° C. to thereby spatter carbon on the surface of a substrate placed between the electrodes. The preferred conditions for spattering carbon include, for example, a vacuum of $5\times10^{-2}$ mmHg, a current of 100 mA and a temperature of about 300° C.

The carbon film need not be formed on the entire surface of the substrate, but may be formed at least on that part of the electrode which is to fall in contact with carbon granules when the transmitter assembly is in service. The carbon film should preferably have a thickness of at least about 0.05 μm, desirably at least about 0.1 μm. The upper limit of the thickness of the carbon film is not critical and from the practical point of view it may be up to about 50 μm. In some cases it is advantageous to subject the substrate to pre-treatment in order to improve the adhesion of the carbon film to the substrate. For this purpose, the substrate may be treated with a chromate.

In accordance with another aspect of the invention there is provided an electrode, for example into a form of the fixed electrode 1 or movable electrode 3 shown in FIG. 1, for a carbon transmitter comprising a cured thermosetting resin molding having 30 to 95% by weight, based on the weight of the electrode, of particulate conductive carbon dispersed therein.

Such an electrode may be prepared by molding a molding material which has been obtained by milling a thermosetting resin, such as phenolic resins and epoxy resins, together with particulate carbon, such as carbon black, graphite powder and carbon fiber, and comminuting the milled mixture. In order to attain the electrical properties required of an electrode for a carbon transmitter, the molding material should contain at least 30% by weight of conductive carbon. For the material to be moldable, the carbon content in the molding material should be not more than 95% by weight. The inventors have found that, while the dynamic resistance is reduced as the carbon content increases, it remains stable for a prolonged period of time irrespective of the carbon content. Moreover, this characteristic is not substantially influenced by the kinds of the carbon and resin materials used.

It has also been found that when the thus molded electrode is calcined at a temperature of 300° C. or higher, for example, about 500° to about 1200° C., in an inert gas, such as nitrogen, the conductivity of the electrode is enhanced and the initial dynamic resistance in the transmitter is reduced.

Figure 2:
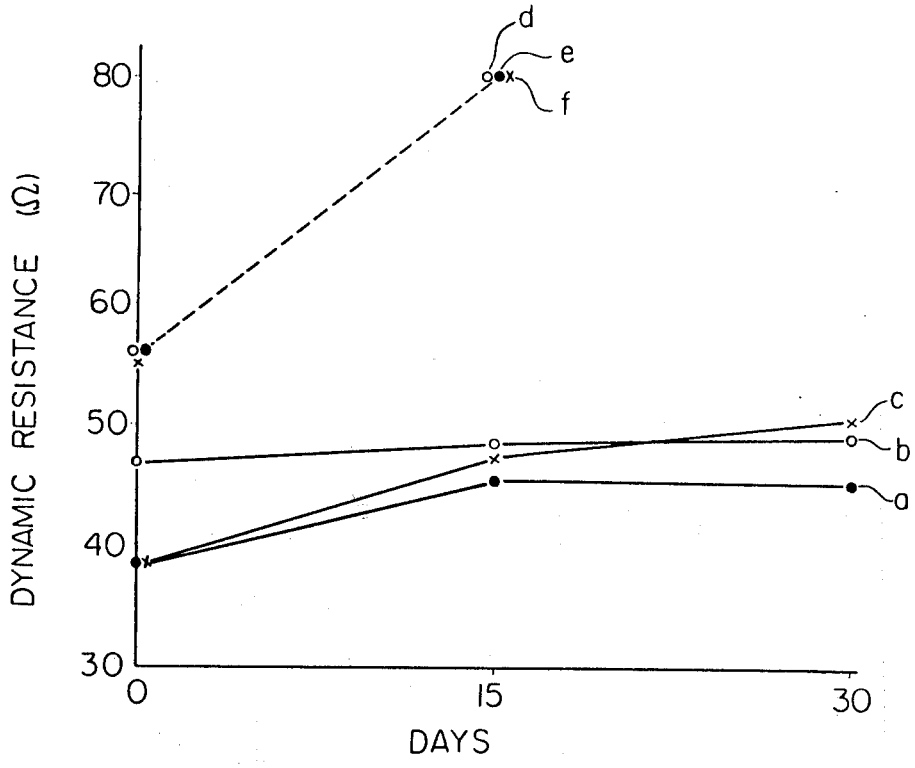
FIGS. 2 and 4 are graphs showing the change of the dynamic resistance with the lapse of time in carbon transmitters equipped with various electrodes.
Figure 3:
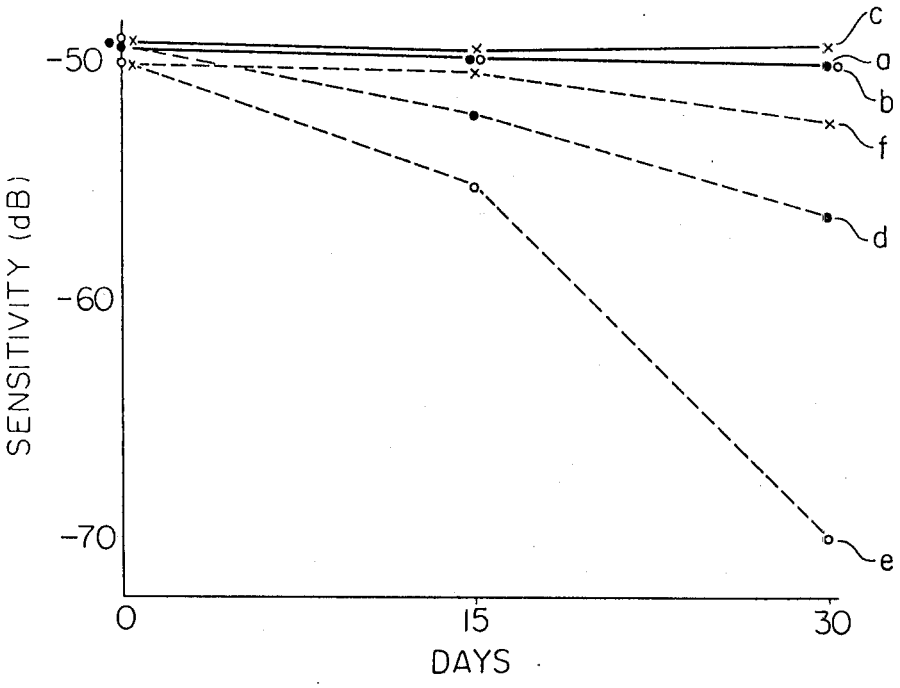
FIGS. 3 and 5 are graphs showing the change of the sensitivity with the lapse of time in carbon transmitters equipped with various electrodes.

Carbon transmitters were constructed as shown in FIG. 1. Each of the carbon transmitters was equipped with a gold-plated electrode as the fixed electrode, while the movable electrode was a gold-plated electrode (sample a), an electrode coated with a conductive paint containing 70% by weight of carbon on dry basis (sample b), a carbon-spattered electrode (sample c), a tin-plated electrode (sample d) a soft solder-plated electrode (sample e) or a nickel-plated electrode (sample f). The carbon transmitters were tested for changes in dynamic resistance (in ohms) and sensitivity (in dB) with time. The substrate was pure copper in each sample. The samples were kept under such accelerated conditions as a temperature of 60° C. and a relative humidity of 90–95%. An electric current of 50 mA was supplied and a noise was set at 80 phones. The dynamic resistance and sensitivity of each transmitter was measured at the start of the test as well as on the 15th and 30th days from the start of the test. The results are shown in FIGS. 2 and 3, which illustrate changes in the dynamic resistance and sensitivity with time, respectively. In FIGS. 2 and 3, curves a, b, c, d, e and f show results with respect to samples a, b, c, d, e and f, respectively.

From the results shown in FIGS. 2 and 3 it will be understood that the carbon-coated electrodes in accordance with the present invention (samples b and c) have stable properties comparable to those of the gold-plated electrode, and that with the tin-plated, soft solder-plated and nickel-plated electrodes, the dynamic resistance and sensitivity change with the lapse of time to an untolerable extent.

Figure 4:
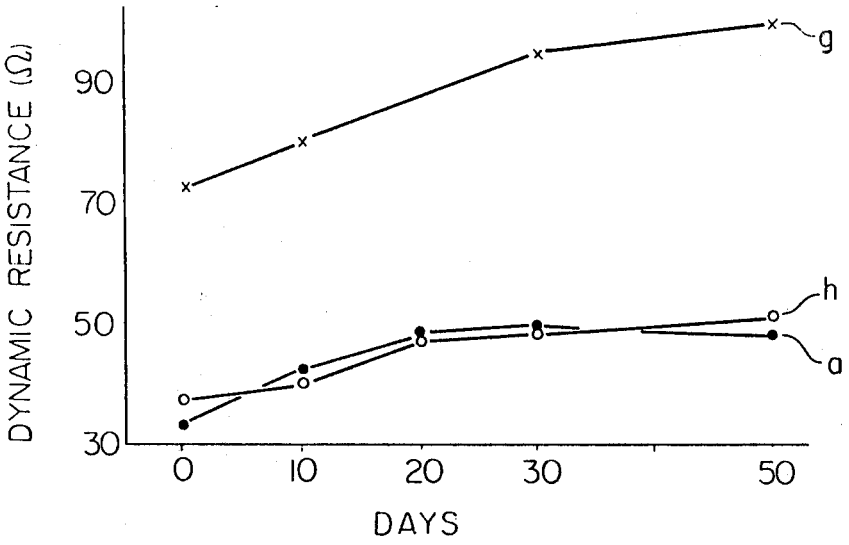
Figure 5:
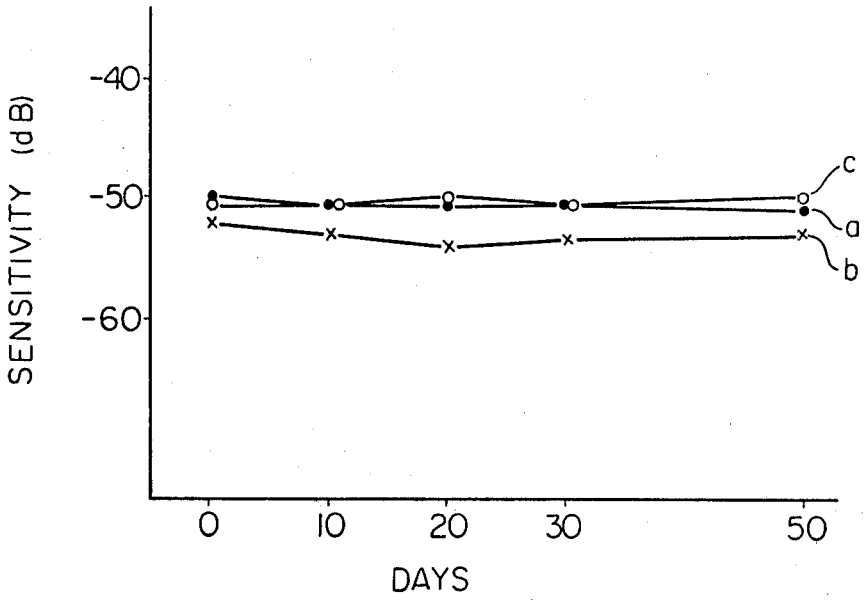

In further experiments, carbon transmitters were again constructed as shown in FIG. 1. Each of the carbon transmitters was equipped with a gold-plate movable electrode (the substrate being copper), while the fixed electrode was a gold-plated electrode (the substrate being copper) (sample a), an electrode formed by molding an epoxy resin containing 60% by weight of carbon (sample g) or an electrode formed by molding a phenolic resin containing 80% by weight of carbon and calcining the molded electrode at a temperature of 800° C. for one hour in a nitrogen atmosphere (sample h). The carbon transmitters were tested. The transmitters were allowed to stand under the same conditions as mentioned hereinbefore, and the dynamic resistance and sensitivity were measured at the start of the test as well as on the 10th, 20th, 30th and 50th days from the start of the test. The results are shown in FIGS. 4 and 5, which illustrate changes in the dynamic resistance and sensitivity with time, respectively. In FIGS. 4 and 5, curves a, g and h show results with respect to samples, a, g and h, respectively.

The results shown in FIGS. 4 and 5 reveal that the carbon-containing electrodes in accordance with the invention are quite comparable to the conventional gold-plated electrode in that they have stable electrical properties.

In addition to the demonstrated stable electrical properties, the electrodes of the invention have satisfactory mechanical properties and can be manufactured at low cost with ease.

What is claimed is:

1. A carbon telephone transmitter comprising:

a diaphragm;

a movable electrode attached to said diaphragm;

a fixed electrode; and a pack of carbon granules packed between said movable and said fixed electrodes, at least one of said electrodes comprising a cured thermosetting resin molding having 30 to 95% by weight, based on the weight of the electrode, of particulate conductive carbon dispersed therein.

2. The carbon transmitter in accordance with claim 1, wherein said molding has been calcined in nitrogen at a temperature of about 500° to about 1200° C.

3. The carbon transmitter in accordance with claim 1, wherein said thermosetting resin molding includes phenolic resin.

4. The carbon transmitter in accordance with claim 1, wherein said thermosetting resin molding includes epoxy resin.

5. The carbon transmitter in accordance with claim 1, wherein said particulate conductive carbon includes carbon fiber.

6. The carbon transmitter in accordance with claim 1, wherein said particulate conductive carbon includes graphite powder.

7. In a carbon transmitter for a telephone having a granular carbon resistance pack between a fixed and a movable electrodes wherein at least one electrode thereof comprises a cured thermosetting resin molding having 30 to 95% by weight particulate conductive carbon dispersed therein, said resin being of a group comprising phenolic resins and epoxy resins.

8. The carbon transmitter of claim 7, wherein said molding contains 70 to 95% of said carbon and has been calcined in an inert gaseous medium at a temperature of 300° C. to 1000° C.

* * * * *

UNITED STATES PATENT OFFICE

CERTIFICATE OF CORRECTION

Patent No. 4,205,206 Dated May 27, 1980

Inventor(s) Tetsusuke Eishima et al

It is certified that error appears in the above-identified patent and that said Letters Patent are hereby corrected as shown below:

On The Title Page:
The name of the fifth co-inventor, which is stated in the patent to be "Takashi Soda" should be ---Takashi Suda---.

Signed and Sealed this

Fourth Day of August 1981

[SEAL]

Attest:

GERALD J. MOSSINGHOFF

Attesting Officer

Commissioner of Patents and Trademarks